US008337384B2

(12) United States Patent
Honma et al.

(10) Patent No.: US 8,337,384 B2
(45) Date of Patent: Dec. 25, 2012

(54) GROMMET STRUCTURE IN INCUBATOR

(75) Inventors: Naoki Honma, Saitama (JP); Shinichi Kobayashi, Saitama (JP); Kazuo Matsubara, Tokyo (JP)

(73) Assignee: Atom Medical Corporation, Tokyo (JP)

( * ) Notice: Subject to any disclaimer, the term of this patent is extended or adjusted under 35 U.S.C. 154(b) by 831 days.

(21) Appl. No.: 12/465,398

(22) Filed: May 13, 2009

(65) Prior Publication Data

US 2010/0004502 A1 Jan. 7, 2010

(30) Foreign Application Priority Data

Jul. 3, 2008 (JP) ..... 2008-174209

(51) Int. Cl.
*A61G 11/00* (2006.01)

(52) U.S. Cl. ..... 600/22

(58) Field of Classification Search ..... 600/21–22; 5/600–606, 652–655
See application file for complete search history.

(56) References Cited

U.S. PATENT DOCUMENTS

| | | | | |
|---|---|---|---|---|
| 5,954,627 | A | 9/1999 | Sekine et al. | |
| 6,336,897 | B1 | 1/2002 | Mackin | |
| 6,345,402 | B1 * | 2/2002 | Prows et al. | 5/658 |
| 6,867,371 | B2 * | 3/2005 | Daoud et al. | 174/652 |

FOREIGN PATENT DOCUMENTS

| | | |
|---|---|---|
| JP | H10-248887 | 9/1998 |
| WO | WO 99/12512 | 3/1999 |

* cited by examiner

*Primary Examiner* — John Lacyk
(74) *Attorney, Agent, or Firm* — Hunton & Williams LLP

(57) ABSTRACT

In this invention, a grommet structure in an incubator includes a grommet attaching portion provided to the enclosure of the incubator and a grommet member attached to the grommet attaching portion. The grommet member includes a longitudinal member holding incision to hold a longitudinal member such as an oxygen supply tube that extends through it. The longitudinal member holding incision forms at least one substantially S-shaped shape (in other words, a substantially sine-curved shape) and/or a substantially waving shape. This invention can provide the grommet structure in the incubator, in which the longitudinal member such as an oxygen supply tube held by the longitudinal incision of the grommet member and extending through the incision is less likely to move accidentally in the longitudinal direction of the incision or in the longitudinal direction of the longitudinal member. Also, a gap through which the inside and outside of the enclosure communicate with each other can be small even when the longitudinal member extends through the incision.

18 Claims, 7 Drawing Sheets

GROMMET STRUCTURE IN INCUBATOR

TECHNICAL FIELD

The present invention relates to a grommet structure in an incubator comprising a grommet attaching portion provided to an enclosure of the incubator and a grommet member attached to the grommet attaching portion, wherein the grommet member includes a longitudinal member holding incision to hold a longitudinal member that extends therethrough.

BACKGROUND OF THE INVENTION

A grommet structure in an incubator comprising a grommet attaching portion provided to an enclosure of the incubator and a grommet member attached to the grommet attaching portion, wherein the grommet member includes a longitudinal member holding incision to hold a longitudinal member such as an oxygen supply tube that extends therethrough, is conventionally known as disclosed in, e.g., International Publication WO 99/12512 (to be referred to as "the above prior patent reference" hereinafter). The grommet member employed the grommet structure disclosed in the above prior patent reference includes a comparatively thick substantially U-shaped attaching target member which is provided to the grommet member along the outer circumference (the entire outer circumference excluding the upper rim) of the grommet member. The substantially U-shaped attaching target member is attached to the grommet attaching portion of the enclosure of the incubator. Of the grommet member, a portion surrounded by the substantially U-shaped attaching target member is comparatively thin and constitutes a cable holder. In this DESCRIPTION, the "cable" refers to various types of longitudinal members such as a tube, cable and electric cord for various types of instruments, e.g., an oxygen mask used in the incubator, or various types of such longitudinal members as a bundle obtained by bundling a plurality of longitudinal members having the same or different diameters (including a case in which a jacket tube such as a bellows tube covers the bundle of the plurality of longitudinal members).

The cable holder of the grommet member of the above prior patent reference also has a cable holding incision formed of one vertical slit and a plurality of horizontal incisions. The vertical slit extends substantially vertically from the upper end of the holder to a region consisting of the lower end of the holder and its vicinity. The plurality of horizontal incisions extend substantially horizontally to be substantially perpendicular to the vertical incision. When the cable is to be held by the cable holder of the grommet member, the operator abuts an appropriate portion of the cable against the vertical incision from above and moves it downward by pushing it into the vertical incision. This introduces the cable into a substantially crisscross intersecting portion where the vertical incision and a horizontal incision intersect. Of the cable holder, four holding pieces that constitute the intersecting portion elastically position and hold the cable at a region consisting of the intersecting portion and its vicinity.

In the case of the grommet structure in the incubator disclosed in the above prior patent reference, as the cable must be elastically held in position at the crisscross intersecting portion (in other words, the four holding pieces) of the cable holder of the grommet member, the cable holder cannot be very thin. As the cable holder of the grommet member cannot be very thin, the four holding pieces of the cable holder have comparatively low elasticity. Therefore, the cable tends to be damaged by repeated slide friction with the four holding pieces. As the four holding pieces cannot position and hold the cable reliably, the cable tends to move downward (or upward depending on the case) along the vertical incision or in the longitudinal direction of the cable. Furthermore, as the cable is inserted in the cable holding incision, a large gap is formed among the four holding pieces. Then, a large amount of external air is introduced through the gap into the enclosure in the closed state.

SUMMARY OF THE INVENTION

The present invention is to solve the drawbacks as described above of the grommet structure in the incubator of the above prior patent reference with a comparatively simple arrangement.

It is, therefore, an object of the present invention to provide a grommet structure in an incubator, in which a longitudinal member, held by a longitudinal member holding incision of a grommet member, that extends through the incision is less likely to move accidentally in the longitudinal direction of the incision or in the longitudinal direction of the longitudinal member.

It is another object of the present invention to provide a grommet structure in an incubator, in which portions on the two sides of an incision can be comparatively thin, so that a gap through which the inside and outside of the enclosure communicate with each other can be small even when a longitudinal member extends through the incision.

It is still another object of the present invention to provide a grommet structure in an incubator, in which a pair of holding pieces can reliably hold a longitudinal member from two sides with an appropriate elastic force, so that a gap through which the inside and outside of the enclosure communicate with each other can be smaller, and the longitudinal member is less likely to be damaged by repeated slide friction with the pair of holding pieces.

It is yet another object of the present invention to provide a grommet structure in an incubator, in which a pair of holding pieces can be thin, so that a gap through which the inside and outside of the enclosure communicate with each other can be further smaller, and a longitudinal member can be less likely to be damaged by repeated slide friction with the pair of holding pieces.

The present invention relates to a grommet structure in an incubator, comprising a grommet attaching portion provided to an enclosure of the incubator and a grommet member attached to the grommet attaching portion wherein the grommet member includes a longitudinal member holding incision to hold a longitudinal member such as an oxygen supply tube that extends therethrough, characterized in that the longitudinal member holding incision forms at least one type of meandrous shape selected from a group consisting of at least one substantially S-shaped shape, at least one substantially sine-curved shape and a substantially waving shape. In this case, the at least one type of meandrous shape may comprise at least one substantially S-shaped shape continuous curve, at least one substantially sine-curved shape continuous curve, or a substantially waving shape. When the at least one type of meandrous shape comprises a substantially S-shaped shape or substantially sine-curved shape, the continuous curve is preferably compressed in a horizontal direction.

According to the first aspect to the present invention, the grommet member comprises a large-thickness attaching target portion provided to the grommet member to extend substantially along an outer circumference of the grommet member and attached to the grommet attaching portion, a pair of small-thickness holding pieces formed on two sides, respectively, of the longitudinal member holding incision substantially along the longitudinal member holding incision, and a planar connector which connects the attaching target portion to the pair of holding pieces in a planar manner, wherein a thickness of the planar connector decreases gradually from the attaching target portion toward the pair of holding pieces.

According to the first aspect of the present invention, preferably, the attaching target portion, the pair of holding pieces and the planar connector of the grommet member are integrally molded from an elastic material. Preferably, each of the pair of holding pieces has a width falling within a range of 3 mm to 18 mm (preferably, 5 mm to 15 mm). Also, desirably, each of the pair of holding pieces has a thickness falling within a range of 0.6 mm to 2.5 mm (preferably, 0.9 mm to 1.8 mm).

According to the second aspect of the present invention, the incision includes a plurality of substantially arcuate projecting portions projecting to the left and right, and the number of projecting portions falls within a range of two to nine (preferably three to seven). In this case, desirably, each of the projecting portions has a width falling within a range of 1.5 cm to 8 cm (preferably 2.5 cm to 6 cm). Also, desirably, each of the projecting portions also has a height falling within a range of 3.5 mm to 20 mm (preferably 6 mm to 15 mm). Furthermore, desirably, a ratio of the height to the width of each of the projecting portions falls within a range of 0.15 to 0.6 (preferably 0.2 to 0.4).

According to the first and second aspects of the present invention, preferably, the attaching target portion comprises an attaching target portion main body formed into a substantially U shape substantially along an outer circumference of the grommet member. Also, preferably, the attaching target portion includes an outer circumferential groove, and a portion of the enclosure which extends along a grommet attaching opening engages with the outer circumferential groove. Furthermore, preferably, the attaching target portion includes a locking portion continuously provided to the attaching target portion main body, and a grommet attaching opening formed in the enclosure includes a notched small opening, the locking portion engaging with the small opening.

According to the third aspect of the present invention, a second incision extending substantially horizontally is formed in a lower end of the incision, and the incision and the second incision form a substantially inverted-T-shaped incision at a region consisting of the intersection of the two incisions and vicinities thereof. According to the fourth aspect of the present invention, the grommet member is attached to the grommet attaching portion provided to at least a wall of one type selected from a group consisting of a front wall, a rear wall, an infant-head-side wall and an infant-leg-side wall that constitute the enclosure. According to the fifth aspect of the present invention, the longitudinal member comprises a cable. According to the sixth aspect of the present invention, the incubator comprises a closed type incubator serving also as an open type incubator.

The above, and other, objects, features and advantages of the present invention will become readily apparent from the following detailed description thereof which is to be read in connection with the accompanying drawings.

DETAILED DESCRIPTION OF THE INVENTION

One embodiment in which the present invention is applied to a closed type incubator serving as an open type incubator as well will be described in "1. Schematic Description on Entire Incubator", "2. Description on Grommet Member" and "3. Description on Attaching Mechanism for Grommet Member" with reference to the accompanying drawings.

1. Schematic Description on Entire Incubator

Figure 1:
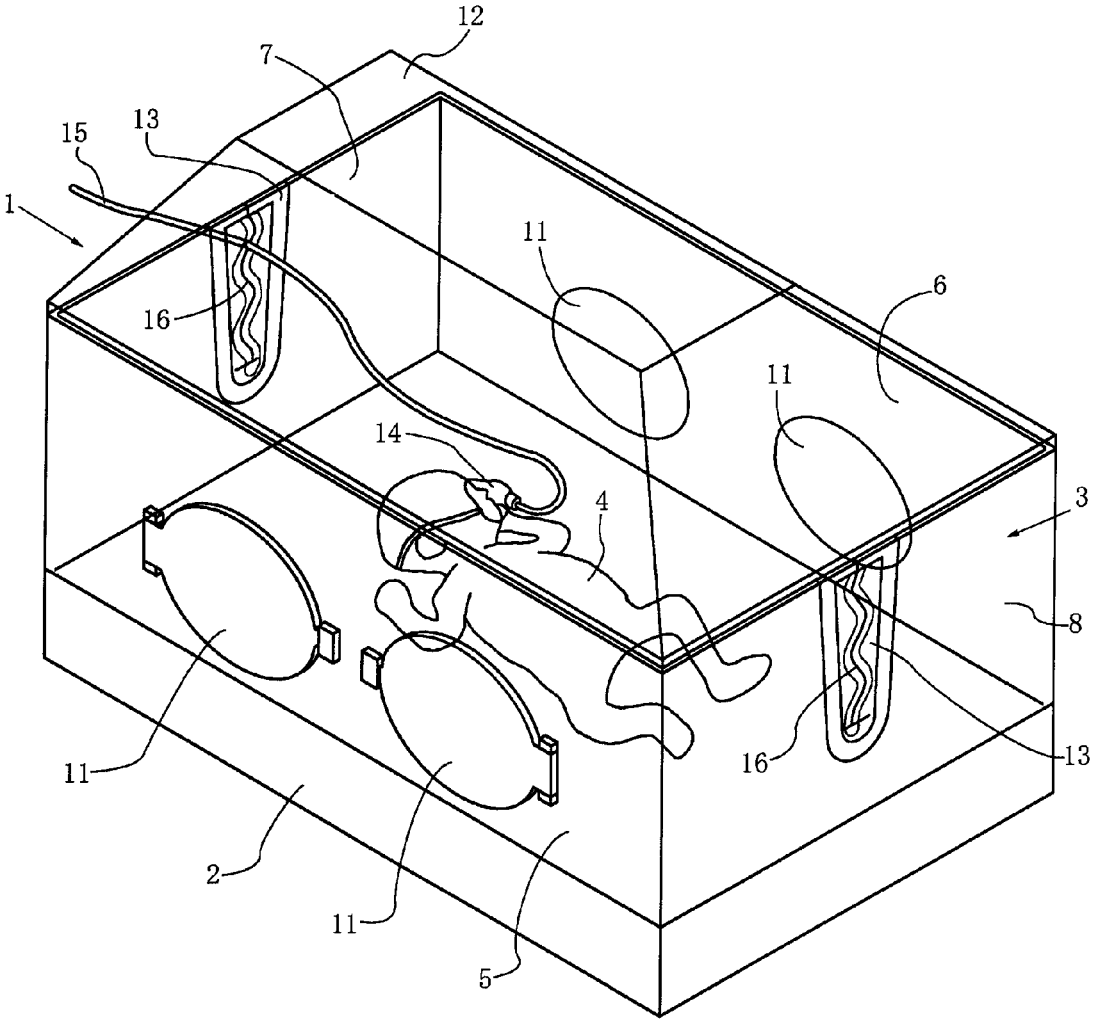
FIG. 1 is a perspective view of an incubator in a closed state in an embodiment in which the present invention is applied to a closed type incubator serving as an open type incubator as well.
Figure 2:
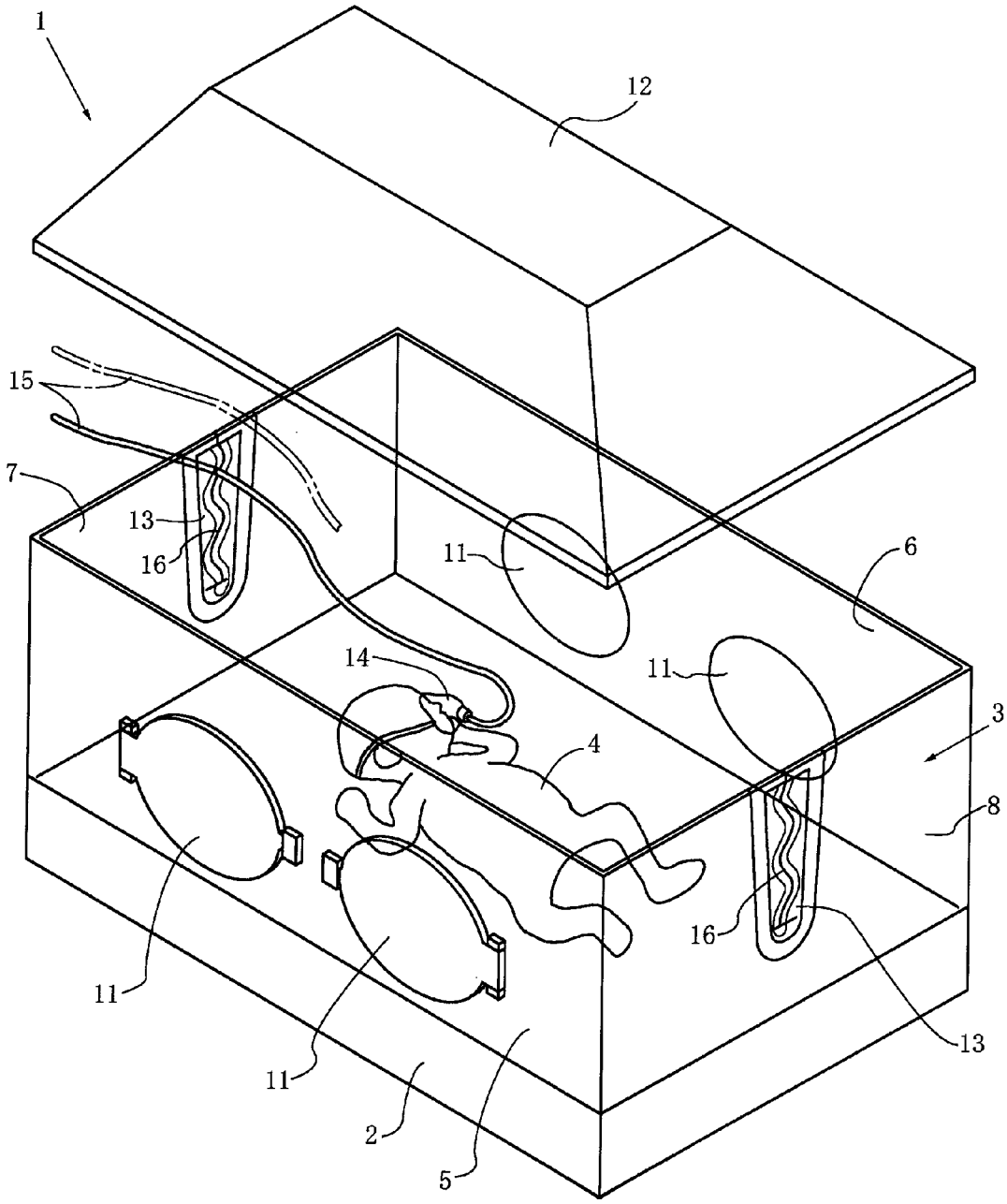
FIG. 2 is a perspective view, similar to FIG. 1, of the incubator in FIG. 1 in an open state.

As shown in FIGS. 1 and 2, an incubator 1 includes a base 2 which has a substantially rectangular shape or the like when seen from the top, and an enclosure 3 standing along substantially the outer circumference of the base 2 and having a substantially rectangular parallelepiped shape or the like. A mattress tray (not shown) is arranged on the base 2. An infant 4 such as an immature infant is accommodated and incubated on the mattress tray. The enclosure 3 can be substantially transparent as a whole, and includes a front wall (in other words, a side guard panel) 5, a rear wall (in other words, a side guard panel) 6, a wall 7 on the head side of the infant 4 (in other words, an end guard panel) and a wall 8 on the leg side of the infant 4 (in other words, an end guard panel). As the front wall 5 constitutes a treatment window, it is pivotal forward toward outside about its lower end as a fulcrum. Servicing windows 11 such as a pair of left and right servicing windows may be arranged in each of the front and rear walls 5 and 6.

The enclosure 3 further includes a top hood 12, as shown in FIGS. 1 and 2. A driving mechanism (neither is shown) such as a retractable support pillar, driving chain and electric motor or the like reciprocally drives the top hood 12 in the vertical direction. When the top hood 12 moves to the lower position, as shown in FIG. 1, the incubator 1 serves as a closed type incubator. When the top hood 12 moves to the upper position, as shown in FIG. 2, the incubator 1 serves as an open type incubator. A grommet member 13 is attached to each of the head-side wall 7 the leg-side wall 8 or the like of the enclosure 3. In the embodiment shown in the drawings, an oxygen supply cable 15 of an oxygen mask 14 to supply oxygen to the infant 4 using an artificial respirator is introduced into the enclosure 3 from outside the enclosure 3 through a cable holding incision 16 of the grommet member 13. Hence, the oxygen supply cable 15 may be a bundle of a plurality of tubes such as an inhaling tube and exhaling tube which is covered with a bellows jacket tube.

Each grommet member 13 and its attaching structure will be described in detail in the following item (namely, "2. Description on Grommet Member") and the subsequent item (namely, "3. Description on Attaching Mechanism for Grommet Member"), respectively, and will be omitted in this item. Except for the grommet member 13 and its attaching mechanism, the arrangement of the incubator 1 can be a known one, and to describe it in detail is not the gist of the present invention. Hence, the arrangement of the incubator 1 will not be illustrated or described in detail in this DESCRIPTION.

2. Description on Grommet Member

As shown in FIGS. 3 to 9, each grommet structure 21 attached to the enclosure 3 (more specifically, the head-side wall 7 and leg-side wall 8) of the incubator 1 shown in FIGS. 1 and 2 includes the grommet member 13 and a grommet attaching portion 22. The grommet attaching portion 22 is provided to the enclosure 3 to attach the grommet member 13 to the enclosure 3 of the incubator 1. The grommet member 13 may be integrally molded using a comparatively soft elastic material such as synthetic rubber, e.g., silicone rubber, natural rubber, or a synthetic resin, e.g., a silicone resin or vinyl resin, into a substantially U shape when seen from the front, which is vertical band-like and solid.

Figure 3:
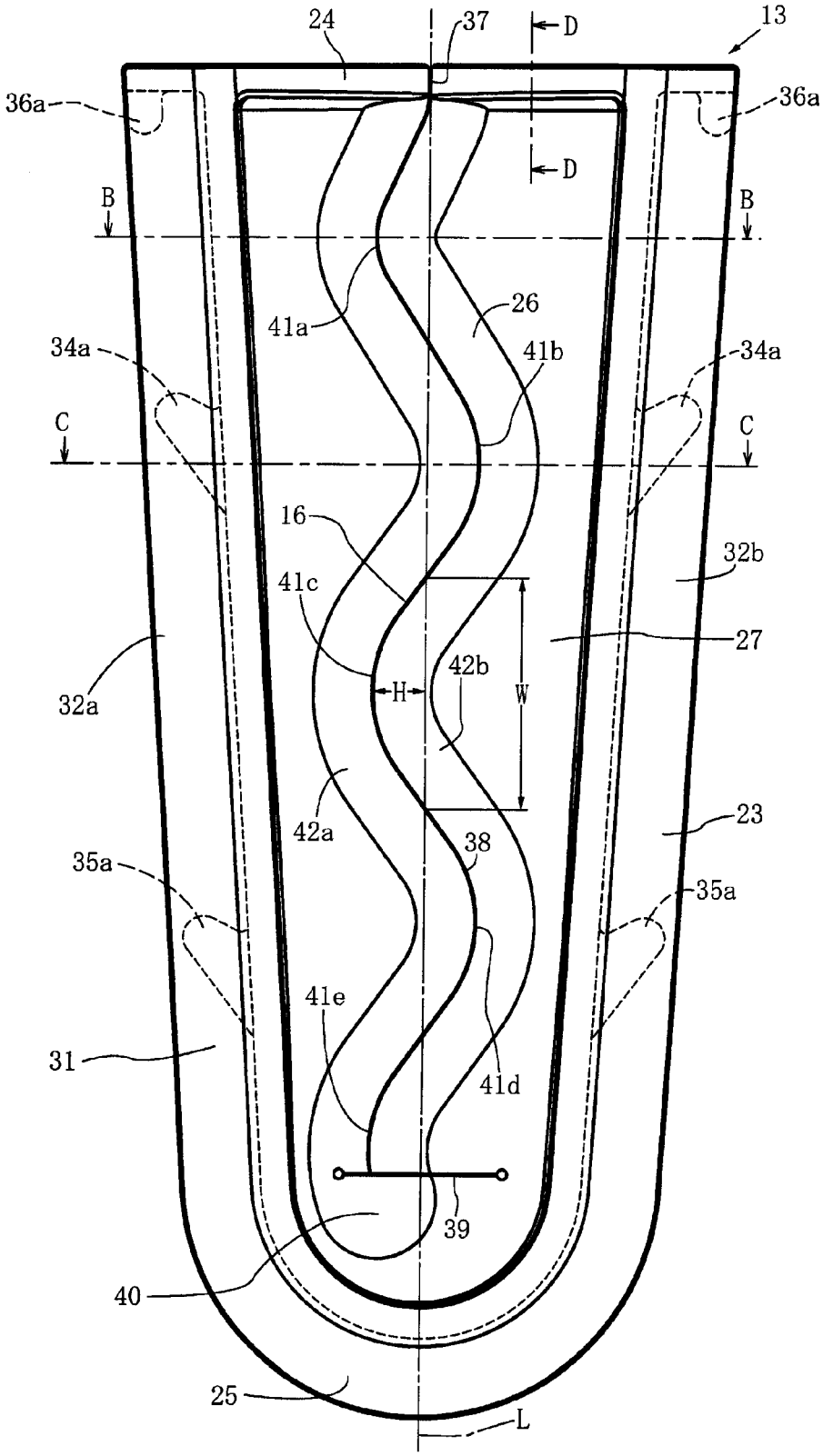
FIG. 3 is a front view, seen from outside the incubator, of a grommet member shown in FIG. 1.
Figure 4:
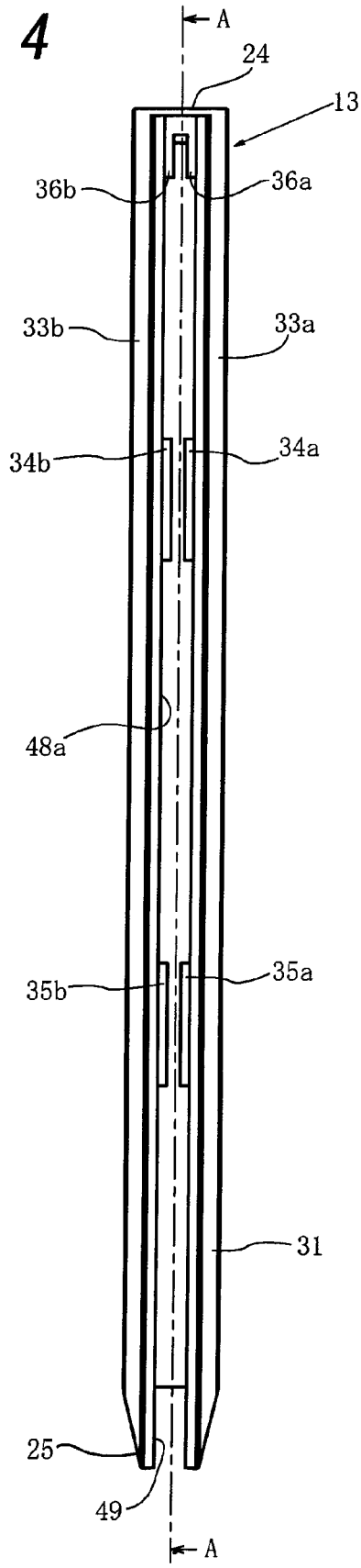
FIG. 4 is a left side view of the grommet member in FIG. 3.

As shown in FIG. 3, the grommet member 13 includes portions described in the following items (a) to (d):

(a) a substantially U-shaped attaching target portion 23 extending substantially along the outer circumference of the grommet member 13 when seen from the front, (b) an upper rim 24 extending substantially between the pair of left and right upper ends of the attaching target portion 23, (c) a cable support 26 extending through substantially the central portion of the grommet member 13, when seen from the front, from the upper rim 24 to a region consisting of a substantially semicircular lower rim 25 of the attaching target portion 23 and its vicinity, and (d) a connector (in other words, a planar connector) 27 extending between the attaching target portion 23 and cable support 26 to fill the gap between them in a planar manner in order to connect them.

Figure 6:
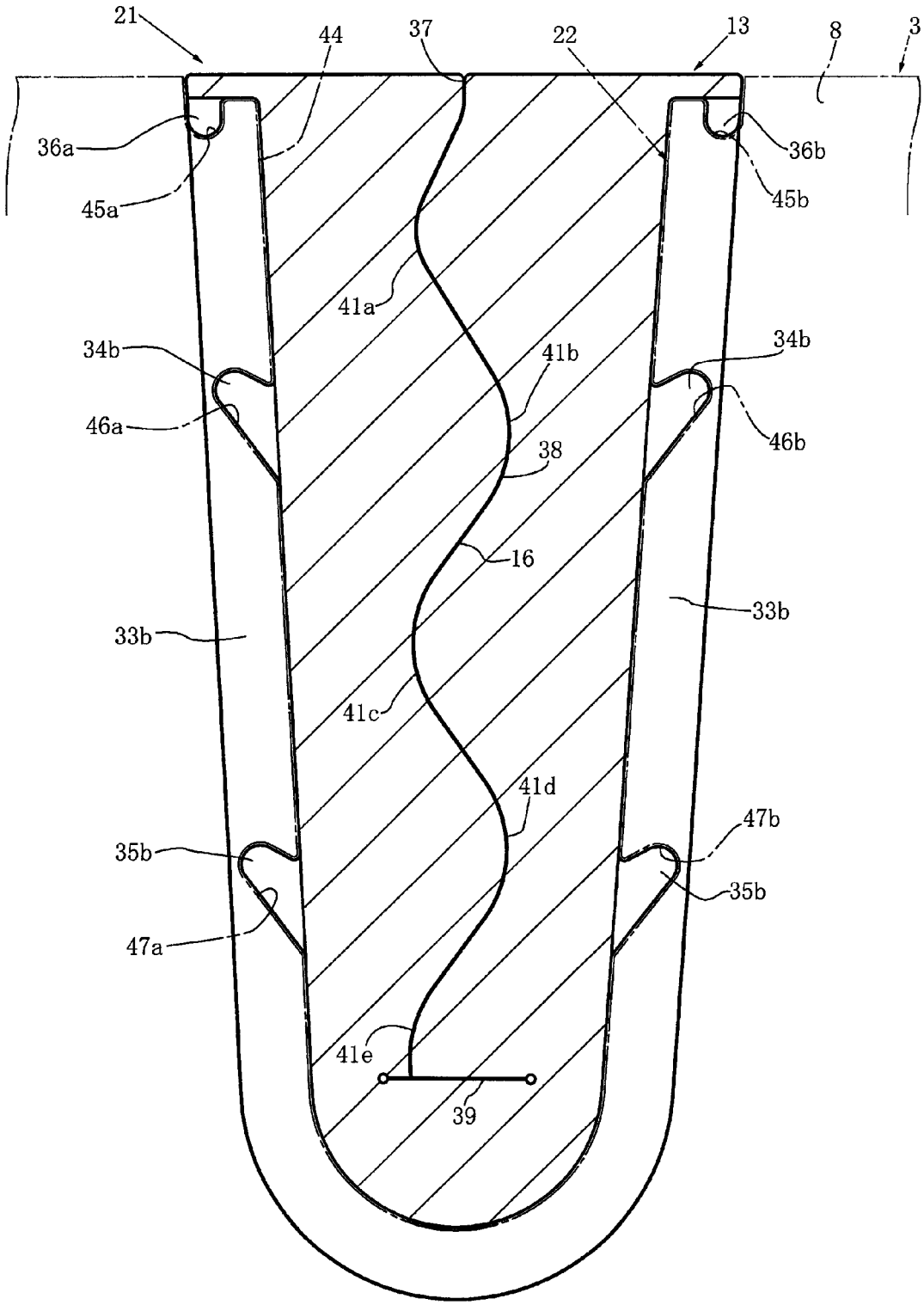
FIG. 6 is a sectional view taken along the line A-A in FIG. 4.
Figure 7:
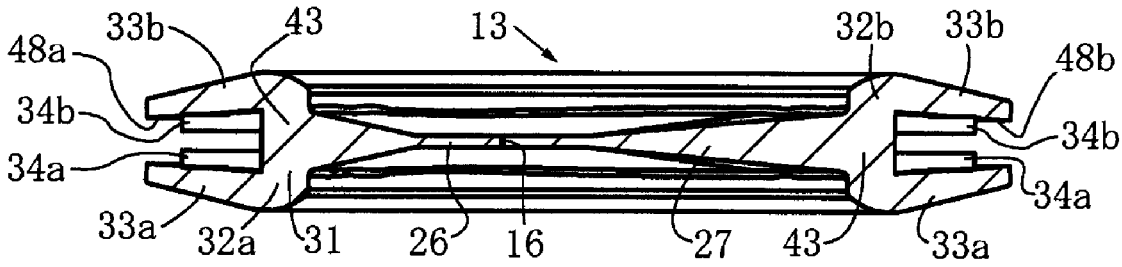
FIG. 7 is a sectional view taken along the line B-B in FIG. 3.
Figure 8:
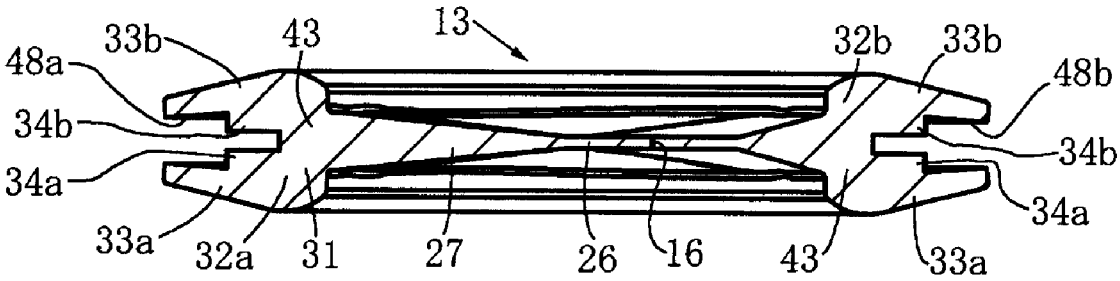
FIG. 8 is a sectional view taken along the line C-C in FIG. 3.
Figure 9:
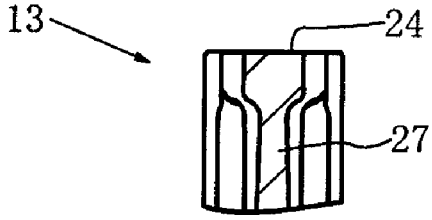
FIG. 9 is a sectional view taken along the line D-D in FIG. 3.

The attaching target portion 23 of the grommet member 13 includes an attaching target portion main body 31 having a substantially U-shaped section, as shown in FIGS. 6 to 8. As the attaching target portion main body 31 extends substantially along the entire outer circumference of the attaching target portion 23, it forms a vertical band-like substantially U shape when seen from the front. Hence, the attaching target portion main body 31 includes a pair of left and right arms 32*a* and 32*b*, as shown in FIG. 3. A pair of front and rear upper locking portions 34*a* and 34*b* and a pair of front and rear lower locking portions 35*a* and 35*b* are formed inside the intermediate portions of a pair of front and rear long plate-shaped portions 33*a* and 33*b* of the pair of left and right arms 32*a* and 32*b* of the attaching target portion main body 31. Also, a pair of front and rear locking portions 36*a* and 36*b* are formed inside regions consisting of the upper ends of the long plate-shaped portions 33*a* and 33*b* and their vicinities. In the embodiment shown in the drawings, the locking portions 34*a* and 34*b*, and 35*a* and 35*b* are formed integrally with the long plate-shaped portions 33*a* and 33*b*, respectively, to project outward from the long plate-shaped portions 33*a* and 33*b*, respectively, obliquely upward, as shown in FIGS. 3, 4, 7 and 8. The locking portions 36*a* and 36*b* are formed integrally with the upper ends of the long plate-shaped portions 33*a* and 33*b* such that the locking portions 36*a* and 36*b* project substantially downward from the lower surfaces of the upper ends of the long plate-shaped portions 33*a* and 33*b*.

An incision 37 is formed at substantially the central portion in the horizontal direction of the upper rim 24 of the grommet member 13. An incision 38 is formed in the cable support 26 and extends vertically while substantially winding from the upper end to a region consisting of the lower end of the cable support 26 and its vicinity. The incisions 37 and 38 constitute the cable holding incision 16 of the grommet member 13. An incision 39 extending substantially in the horizontal direction is formed at the lower end of the incision 38 to be continuous to it, so that it is substantially perpendicular to the incision 38, thus forming a substantially-inverted-T shape. The incision 38 (in other words, the cable holding incision 16) can have a substantially waving shape, as shown in FIG. 3. In other words, the incision 16 can have a shape obtained by connecting a plurality (in other words, two or more) of substantially S shapes, or one substantially S shape. In other words, the incision 16 can have a shape obtained by connecting a plurality (in other words, two or more) of substantially sine-curved shapes, or one substantially sine-curved shape. In this case, each of the substantially S shape and the substantially sine-curved shape is preferably compressed in the horizontal direction (in other words, in a direction perpendicular to a center line L extending in the longitudinal direction of the incision 16). The incision 16 preferably forms a continuous curve obtained by connecting two or more substantially arcuate projecting portions extending from the center line L to the left and right.

In the embodiment shown in the drawings, the cable holding incision 16 has about 4.5 pieces of substantially arcuate projecting portions 41*a*, 41*b*, 41*c*, 41*d* and 41*e*, as shown in FIG. 3, on the left and right sides of the center line L extending in the longitudinal direction of the incision 16. Note that the size of the arcuate projecting portion 41*e* is substantially half that of each of the remaining arcuate projecting portions 41*a* to 41*d*. Generally, the number of arcuate projecting portions 41*a* to 41*e* of the incision 16 preferably falls within a range of two to nine from the viewpoint of practicality, and desirably a range of three to seven. Assume that the length of each of the arcuate projecting portions 41*a* to 41*d* in the longitudinal direction of the incision 16 (in other words, the width of each of the arcuate projecting portions 41*a* to 41*e*) is defined as W and that the length of each of the arcuate projecting portions 41*a* to 41*d* in the widthwise direction of the incision 16 (in other words, the height of each of the arcuate projecting portions 41*a* to 41*e*) is defined as H. In this case, the ratio of the height H to the width W (that is, H/W) is about 0.25 in the embodiment shown in the drawings. Generally, the ratio H/W preferably falls within a range of 0.15 to 0.6 from the viewpoint of practicality, and desirably a range of 0.2 to 0.4. The width W is about 3.3 cm in the embodiment shown in the drawings. Generally, the width W preferably falls within a range of 1.5 cm to 8 cm from the viewpoint of practicality, and desirably a range of 2.5 cm to 6 cm. The height H is about 8 mm in the embodiment shown in the drawings. Generally, the height H preferably falls within a range of 3.5 mm to 20 mm from the viewpoint of practicality, and desirably a range of 6 mm to 15 mm.

As shown in FIG. 3, the cable support 26 of the grommet member 13 has a pair of left and right holding pieces 42*a* and 42*b* extending on the left and right sides, respectively, of the incision 38. A link 40 at the lower end of the incision 38 connects the pair of left and right holding pieces 42*a* and 42*b* partially via the incision 39. Hence, in substantially the same manner as the incision 38, the pair of left and right holding pieces 42*a* and 42*b* also extend to substantially form a band (in other words, with substantially the same width) while substantially winding downward from above. In the embodiment shown in the drawings, each of the pair of left and right holding pieces 42*a* and 42*b* has a width of about 9 mm. Generally, this width preferably falls within a range of 3 mm to 18 mm from the viewpoint of practicality, and desirably a range of 5 mm to 15 mm. In the embodiment shown in the drawings, each of the pair of left and right holding pieces 42*a* and 42*b* has a substantially equal overall thickness, as shown in FIGS. 7 and 8, and its thickness is about 1.2 mm. Generally, this thickness preferably falls within a range of 0.6 mm to 2.5 mm from the viewpoint of practicality, and desirably a range of 0.9 mm to 1.8 mm.

Figure 5:
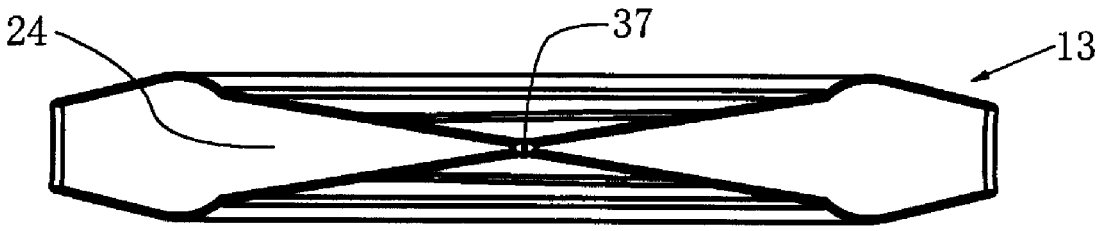
FIG. 5 is a plan view of the grommet member in FIG. 3.

The attaching target portion main body 31 of the attaching target portion 23 of the grommet member 13 has a base plate portion 43 which connects the pair of long plate-shaped portions 33*a* and 33*b*, as shown in FIGS. 7 and 8. The base plate portion 43 is sufficiently thicker than each of the holding pieces 42*a* and 42*b*. The thickness of the planar connector 27 gradually decreases from the base plate portion 43 (in other words, the attaching target portion main body 31 and furthermore the attaching target portion 23) toward the holding pieces 42*a* and 42*b* and, near the holding pieces 42*a* and 42*b*, is substantially equal to that of each of the holding pieces 42*a* and 42*b*. The thickness of the upper rim 24 of the grommet member 13 also gradually decreases from its two ends toward the incision 37, as shown in FIG. 5 and, in a region consisting of the incision 37 and its vicinity, is substantially equal to that of each of the holding pieces 42*a* and 42*b*.

3. Description on Attaching Mechanism for Grommet Member

The enclosure 3 (in the embodiment shown in the drawings, the head-side wall 7 and leg-side wall 8) has openings (in other words, grommet attaching openings) 44 to constitute the grommet attaching portions 22, as shown in FIGS. 1 and 6. The openings 44 form notches communicating with the outside at the upper ends (in other words, the ends) of the walls 7 and 8, respectively. In the following description, the attaching structure for the grommet member 13 attached to the leg-side wall 8 will be described with reference to FIGS. 1, 2 and 6. Note that the grommet member 13 attached to the head-side wall 7, and its attaching structure can be substantially the same as those of the leg-side wall 8.

Basically, the grommet opening 44 has a shape substantially conforming to the outer circumference of the link 40 of the attaching target portion 23 of the grommet member 13, as shown in FIG. 6. The opening 44 has notched small openings 45*a* and 45*b*, 46*a* and 46*b* and 47*a* and 47*b* at portions adjacent to regions consisting of the upper end portions of the pair of left and right arms 32*a* and 32*b* of the attaching target portion 23 and their vicinities (including the locking portions 36*a* and 36*b*), portions adjacent to the upper locking portions 34*a* and 34*b* and portions adjacent to the lower locking portions 35*a* and 35*b*, respectively. The small openings 45*a*, 45*b*, 46*a*, 46*b*, 47*a* and 47*b* communicate with the opening 44 to constitute part of the opening 44.

When attaching the grommet member 13 to the grommet attaching portion 22 of the leg-side wall 8, the grommet member 13 is inserted from its lower end into the grommet attaching opening 44 and fitted in the opening 44. In this case, those portions of the leg-side wall 8 which extend along the circumference of the opening 44 are fitted in (in other words, engage with) outer circumferential grooves 48*a* and 48*b* of the left and right arms 32*a* and 32*b* and the outer circumferential groove 49 (see FIGS. 4 and 7) of the lower rim 25, respectively, of the attaching target portion 23 of the grommet member 13. When inserting the grommet member 13, the lower locking portions 35*a* and 35*b*, and upper locking portions 34*a* and 34*b* slid downward along that portion of the leg-side wall 8 which extends along the circumference of the opening 44, while enlarging the gap between the lower locking portions 35*a* and 35*b* and the gap between the upper locking portions 34*a* and 34*b* in the direction of thickness of the leg-side wall 8, and are fitted in the small openings 47*a* and 47*b*, and 46*a* and 46*b*, respectively. The upper ends of the pair of left and right arms 32*a* and 32*b* and the locking portions 36*a* and 36*b* of the attaching target portion 23 are fitted in (in other words, engage with) the small openings 45*a* and 45*b*, respectively, and the upper surface of the upper rim 24 becomes substantially flush with the upper surface of the leg-side wall 8, as shown in FIGS. 2 and 6.

With the above attaching operation, the grommet member 13 can be attached to the enclosure 3, as shown in FIGS. 2 and 6. In this attached state (in other words, the state in which the incubator 1 serves as an open type incubator as shown in FIG. 2), the cable 15 can be introduced into the enclosure 3 from outside and above the enclosure 3 via the incision 16 of the grommet member 13. More specifically, when the operator abuts an appropriate portion of the cable 15 against the incision 37 of the upper rim 24 from above and moves it downward by pushing it into the incision 37, the cable 15 is introduced into the incision 38 of the cable support 26 through the incision 37. Then, the pair of comparatively highly elastic holding pieces 42*a* and 42*b* elastically hold the cable 15 at an appropriate position. The pair of holding pieces 42*a* and 42*b*, on the incision 37 side (in other words, on a side above the cable 15) and a side opposite to it (in other words, on a side under the cable 15), are respectively provided with substantially arcuate recess and substantially arcuate projection (e.g., 41*a* and 41*b*) that engage with each other. Thus, the pair of holding pieces 42*a* and 42*b* hold the cable 15 with an appropriate elastic force, so that the cable 15 will not move upward or downward accidentally or in its longitudinal direction. Therefore, the cable 15 will not be damaged by repeated slide friction with the pair of holding pieces 42*a* and 42*b*. Furthermore, the pair of holding pieces 42*a* and 42*b* are thin and largely elastic. Therefore, even if the cable 15 is inserted in the incision 37, when the incubator 1 serves as a closed type incubator as shown in FIG. 1, the gap through which the inside and outside of the enclosure 3 communicate with each other (in other words, the gap formed between the pair of holding pieces 42*a* and 42*b* when the cable 15 is inserted in the above manner) can be formed as small as possible. As a result, when the incubator 1 serves as the closed type incubator, the external air introduced into the enclosure 3 through the gap can be minimized.

From the above reason, the grommet structure 21 in the embodiment shown in the drawings is particularly suitable in the closed type incubator 1 serving also as an open type incubator. More specifically, when the incubator 1 serves as an open type incubator, the cable support 26 can hold the cable 15 with very simple manipulation as described above. On the other hand, when the incubator 1 serves as a closed type incubator, the amount of external air to be introduced into the enclosure 3 can be minimized, as described above. If a comparatively large instrument such as the oxygen mask 14 is not attached to the distal end of the cable 15, the cable 15 can be held between the pair of holding pieces 42*a* and 42*b* by inserting the distal end of the cable 15 into the incision 38 from outside the enclosure 3.

Having described a specific preferred embodiment of this invention with reference to the accompanying drawings, it is to be understood that the invention is not limited to that precise embodiment, and that various changes and modifications may be effected therein by one skilled in the art without departing from the scope or spirit of the invention as defined in the appended claims.

For example, in the embodiment described above, the grommet member 13 is attached to the attaching portion 22 of the enclosure 3 such that the center line L is substantially vertical. Alternatively, the grommet member 13 can be attached such that the center line L is tilted with respect to the enclosure 3, or substantially horizontally. When attaching the grommet member 13 in a tilted state in this manner, the upper rim 24 of the grommet member 13 need not be substantially perpendicular to the center line L, but may be tilted.

In the embodiment described above, the grommet attaching opening 44 of the grommet attaching portion 22 of the enclosure 3 has a notched shape, and the upper rim 24 (in other words, the incision 16) of the grommet member 13 and the upper ends of the pair of left and right arms 32*a* and 32*b* are exposed to the outside. As the incision 16 need not always be exposed to the outside, the grommet attaching opening 44 may form a closed loop. In this case, the cable 15 can be held between the pair of holding pieces 42*a* and 42*b* by inserting the distal end or proximal end of the cable 15, to which no comparatively large instrument 14 is attached, into the incision 16 (in other words, the incision 38) from outside or inside the enclosure 3.

In the above embodiment, the present invention is applied to a closed type incubator serving also as an open type incubator. However, the present invention can also be applied to an open type incubator. Depending on the case, the present invention can also be applied to a closed type incubator, a transport incubator, and the like. In this case, that portion or the like of the top hood 12 which substantially corresponds to the grommet structure 21 may be formed of a grommet inserting openable/closeable lid that can be opened upward.

The invention claimed is:

1. A structure, comprising a grommet attaching portion provided to an enclosure of an incubator and a grommet member attached to said grommet attaching portion, wherein said grommet member includes a longitudinal member holding incision to hold a longitudinal member that extends therethrough, said longitudinal member holding incision forms at least one type of meandrous shape selected from a group consisting of at least one substantially S-shaped shape, at least one substantially sine-curved shape and a substantially waving shape, said incision includes a plurality of substantially arcuate projecting portions projecting to the left and right, and the number of said projecting portions falling within a range of two to nine.

2. A structure according to claim 1, wherein said at least one type of meandrous shape comprises at least one substantially S-shaped shape continuous curve, said continuous curve being compressed in a horizontal direction.

3. A structure according to claim 1, wherein said at least one type of meandrous shape comprises at least one substantially sine-curved shape continuous curve, said continuous curve being compressed in a horizontal direction.

4. A structure according to claim 1, wherein the at least one type of meandrous shape comprises a substantially waving shape.

5. A structure according to claim 1, wherein said grommet member comprises a large-thickness attaching target portion provided to said grommet member to extend substantially along an outer circumference of said grommet member and attached to said grommet attaching portion, a pair of small-thickness holding pieces formed on two sides, respectively, of said longitudinal member holding incision substantially along said longitudinal member holding incision, and a planar connector which connects said attaching target portion to said pair of holding pieces in a planar manner, and a thickness of said planar connector decreases gradually from said attaching target portion toward said pair of holding pieces.

6. A structure according to claim 5, wherein said attaching target portion, said pair of holding pieces and said planar connector of said grommet member are integrally molded from an elastic material.

7. A structure according to claim 5, wherein each of said pair of holding pieces has a width falling within a range of 3 mm to 18 mm, and each of said pair of holding pieces has a thickness falling within a range of 0.6 mm to 2.5 mm.

8. A structure according to claim 5, wherein each of said pair of holding pieces has a width falling within a range of 5 mm to 15 mm, and each of said pair of holding pieces has a thickness falling within a range of 0.9 mm to 1.8 mm.

9. A structure according to claim 1, wherein the number of said projecting portions falling within a range of three to seven.

10. A structure according to claim 1, wherein each of said projecting portions has a width falling within a range of 1.5 cm to 8 cm, each of said projecting portions has a height falling within a range of 3.5 mm to 20 mm, and a ratio of the height to the width of each of said projecting portions falls within a range of 0.15 to 0.6.

11. A structure according to claim 9, wherein each of said projecting portions has a width falling within a range of 2.5 cm to 6 cm, each of said projecting portions has a height falling within a range of 6 mm to 15 mm, and a ratio of the height to the width of each of said projecting portions falls within a range of 0.2 to 0.4.

12. A structure according to claim 5, wherein said attaching target portion comprises an attaching target portion main body formed into a substantially U shape substantially along an outer circumference of said grommet member.

13. A structure according to claim 5, said attaching target portion includes an outer circumferential groove, and a portion of said enclosure which extends along a grommet attaching opening engages with said outer circumferential groove.

14. A structure according to claim 5, wherein said attaching target portion includes a locking portion continuously provided to said attaching target portion main body, and a grommet attaching opening formed in said enclosure includes a notched small opening, said locking portion engaging with said small opening.

15. A structure according to claim 1, wherein a second incision extending substantially horizontally is formed in a lower end of the incision, and said incision and said second incision form a substantially inverted-T-shaped incision at a region consisting of the intersection of said two incisions and vicinities thereof.

16. A structure according to claim 1, wherein said grommet member is attached to said grommet attaching portion provided to at least a wall of one type selected from a group consisting of a front wall, a rear wall, an infant-head-side wall and an infant-leg-side wall that constitute the enclosure, and said longitudinal member comprises a cable.

17. A structure according to claim 1, further comprising an incubator, wherein said incubator comprises a closed type incubator serving also as an open type incubator.

18. A structure according to claim 1, wherein said incision is open at an upper end of a wall of said enclosure and in that a longitudinal center line of said incision extends in a direction perpendicular to said upper end of said wall.

* * * * *